US008177081B2

(12) United States Patent
Bohnacker

(10) Patent No.: US 8,177,081 B2
(45) Date of Patent: May 15, 2012

(54) LATTICE MAST CRANE AND LATTICE MAST BOOM

(75) Inventor: Roland Bohnacker, Blaubeuren (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 145 days.

(21) Appl. No.: 12/384,261

(22) Filed: Apr. 2, 2009

(65) Prior Publication Data

US 2009/0261053 A1 Oct. 22, 2009

(30) Foreign Application Priority Data

Apr. 4, 2008 (DE) ..... 20 2008 004 663 U

(51) Int. Cl.
*B66C 23/42* (2006.01)

(52) U.S. Cl. ..... 212/300; 212/177; 212/278; 212/297

(58) Field of Classification Search ..... 212/300, 212/177, 176, 168, 278, 270
See application file for complete search history.

(56) References Cited

U.S. PATENT DOCUMENTS

| | | | | |
|---|---|---|---|---|
| 2,701,647 | A * | 2/1955 | Cope | 212/347 |
| 3,249,238 | A * | 5/1966 | Hedeen | 212/347 |
| 3,792,555 | A * | 2/1974 | Sung | 52/115 |
| 3,856,150 | A * | 12/1974 | Wellman | 212/297 |
| 3,868,022 | A * | 2/1975 | Greenlay et al. | 212/291 |
| 3,949,882 | A * | 4/1976 | Reich | 212/176 |
| 4,045,936 | A * | 9/1977 | Sterner | 52/632 |
| 4,253,579 | A | 3/1981 | Williams | |
| 4,752,012 | A * | 6/1988 | Juergens | 212/278 |
| 6,422,408 | B1 * | 7/2002 | Lissandre et al. | 212/270 |

FOREIGN PATENT DOCUMENTS

| | | |
|---|---|---|
| DE | 1431878 | 11/1968 |
| EP | 0 893 392 A2 * | 1/1999 |
| JP | 2004-35116 A * | 2/2004 |

* cited by examiner

*Primary Examiner* — Emmanuel M Marcelo
(74) *Attorney, Agent, or Firm* — Dilworth & Barrese, LLP

(57) ABSTRACT

This invention relates to a lattice mast crane with a lattice mast boom to be luffed up in a vertical luffing plane, which comprises a pivot piece, a plurality of lattice pieces releasably connectable with each other, and a head piece. In accordance with the invention, the lattice mast boom includes a first and a second region, wherein in the first region the lattice mast boom includes at least two first strands of interconnected first lattice pieces extending in parallel in longitudinal direction of the boom, which are connected with the pivot piece via a lower cross-beam and with the head piece via an upper cross-beam, and wherein in the second region the lattice mast boom only consists of a second strand of interconnected second lattice pieces.

18 Claims, 6 Drawing Sheets

LATTICE MAST CRANE AND LATTICE MAST BOOM

BACKGROUND OF THE INVENTION

The present invention relates to a lattice mast crane with a lattice mast boom to be luffed up in a vertical luffing plane, which comprises a pivot piece, a plurality of lattice pieces releasably connectable with each other, and a head piece.

In such lattice mast cranes, the dismantled lattice mast boom can be transported to the hoisting site and be assembled there by connecting pivot piece, lattice pieces and head piece. Advantageously, the lattice pieces, the pivot piece and/or the head piece can be bolted to each other. In the working condition of the lattice mast crane, the lattice mast boom is pivotally mounted on the uppercarriage of the lattice mast crane about a horizontal luffing axis and hence can be luffed up in the vertically extending luffing plane.

In particular, the present invention relates to a lattice mast crane with an undercarriage and an uppercarriage rotatably arranged on the undercarriage about a vertical axis, on which uppercarriage the lattice mast boom is pivotally mounted so as to be luffed up about a horizontal axis. The lattice mast crane advantageously is movable, in particular via tracked traveling gears. Furthermore, there can also be provided a derrick boom, via which the lattice mast boom is braced.

During luffing, the lattice mast boom of the lattice mast cranes described above usually is held by bracing cables. When lifting great loads with lattice mast booms (in contrast to unbraced telescopic booms), the criterion for the peak lifting capacities in a steep position is not the deflection of the boom in the luffing plane, but the lateral deformation vertical to the luffing plane, as can be illustrated with reference to FIGS. 1*a* and 1*b*. Here, the front view of two lattice booms of different width is shown schematically. FIG. 1*a* shows a lattice mast boom 30 which can be luffed up about the luffing axis 6 in a plane vertical to the image plane. FIG. 1*b* shows a lattice mast boom 31, which likewise can be luffed up about the luffing axis 6 in a plane vertical to the image plane. If the lattice mast boom 30 of the width B, which is shown in FIG. 1*a*, undergoes a lateral deflection S1 due to a laterally acting force $F_s$, e.g. a wind force, without bearing a load yet, lifting a load with the already existing deflection S1 causes a great lateral moment. If, as shown in FIG. 1*b*, a lattice mast boom 31 is used with a width B', which is greater than B, the case improves, since the lattice mast boom is deformed less by the laterally acting force $F_s$, and hence only undergoes a lateral deflection S2<S1. Correspondingly, the lateral moment also is smaller. In addition, the stiffness of the lattice mast boom against the lateral moment generated by the load is increased due to the increased width.

In known lattice mast booms, the lattice mast is composed of the pivot piece, a single strand of interconnected lattice pieces and the head piece, so that the width of the boom corresponds to the width of the lattice pieces. To increase the lateral stiffness of such a construction, greater lattice pieces must therefore be used. To be able to lift greater loads, a completely new boom must therefore be bought, so that high investment costs are incurred for the crane operators.

In DE 10 2006 015 307 A1 it therefore is proposed to pivotally mount two booms of smaller cranes one beside the other in parallel on one large crane and connect the two booms with each other via cross-beams. For this purpose, however, the basic machine for the large crane, on which the two booms are pivotally mounted in parallel via their respective pivot pieces and which must have two winches, via which the hoisting cables of the two booms are operated, must be redesigned completely. Hence, this furthermore involves extremely high investment costs for the crane operator, since he still can use the boom, but must buy a completely new basic machine.

SUMMARY OF THE INVENTION

Therefore, it is the object of the present invention to provide a lattice mast crane which allows high lifting capacities with only low investment costs for the crane operator. In addition, the crane of the invention should rather flexibly be adaptable to different loads, hoisting heights and outreaches.

In accordance with the invention, this object is solved by a lattice mast crane according to the description herein. The lattice mast crane has a lattice mast boom to be luffed up in a vertical luffing plane, which comprises a pivot piece, a plurality of lattice pieces releasably connectable with each other, and a head piece. In accordance with the invention, the lattice mast boom now includes a first and a second region, wherein in the first region the lattice mast boom includes at least two first strands of interconnected first lattice pieces, which are connected with the pivot piece via a lower cross-beam and with the head piece via an upper cross-beam, and wherein in the second region the lattice mast boom only consists of a second strand of interconnected second lattice pieces.

By using two first strands in a first region, a particularly stable lattice mast boom thus can be realized. The second region advantageously is formed of already existing lattice pieces of the main boom, the first region of already existing lattice pieces of the luffing jib, so that only low investment costs are incurred. Furthermore, the lattice boom of the invention advantageously can be used on an already existing basic machine of a known lattice mast crane.

In the lattice mast boom of the invention, already existing lattice pieces thus can be employed, in order to flexibly adapt the lattice mast boom to the stroke to be performed. In the first region, the at least two first strands extend one beside the other in longitudinal direction of the boom from the lower cross-beam to the upper cross-beam and thus provide a reinforced region. Advantageously, the first strands extend parallel to each other, so that the distance of the first strands on the upper or lower cross-beam does not change, independent of the number of first lattice pieces used and of the length of the first region. Advantageously, the total width of the first in particular parallel strands, which is composed of the respective widths of the first in particular parallel strands and their spacing, is greater than the width of the second strand. By using two first strands in the first region, a particularly broad lattice mast boom thus can be realized, which in terms of the number of lattice pieces is of course shorter than a lattice mast boom with only one strand. Due to the second region with only one strand, however, the length of the lattice mast boom can be increased. In this way, the lattice mast boom can individually be adjusted to the stroke, wherein only two new parts, the lower and the upper cross-beam, must newly be bought by the crane operator. This provides for an increase in the lifting capacity with only minimal additional investment costs.

Advantageously, all first lattice pieces are identically constructed in terms of geometry, i.e. they have no geometrical differences with respect to their dimensions and/or with respect to their connecting regions. Furthermore advantageously, all second lattice pieces also are identically constructed in terms of geometry, i.e. they have no geometrical differences with respect to their dimensions and/or with respect to their connecting regions. Therefore, standard elements can be employed, as is common practice in lattice mast booms. As regards the remaining configuration, the individual lattice pieces can, however, be quite different. For instance, first and second lattice pieces mounted further down in the boom advantageously have a higher lifting capacity than first and second lattice pieces mounted further up, in particular in that for the lower lattice pieces tubes with greater wall thicknesses are used than for the upper lattice pieces. If necessary, further stiffenings can also be provided.

Advantageously, the second strand is connected with the at least two first strands via the upper cross-beam. Hence, the second strand is arranged above the two first strands, so that the reinforced region with the two strands is located in the lower part of the lattice mast boom. This results in an increased lifting capacity of the lattice mast boom, since the same is loaded more in the lower part than in the upper part due to lateral loads and correspondingly has a smaller lateral deformation due to an increased lateral stiffness in the lower region.

Advantageously, the first lattice pieces have a smaller cross-sectional area than the second lattice pieces. Cross-sectional area of a lattice piece is understood to be the area spanned by the longitudinal struts of the lattice pieces, i.e. the product of the depth and the width of the lattice pieces. In particular, first lattice pieces can be used here, which usually are employed in regions of the boom that are loaded less, such as in the outer ends of the luffing jib. Many crane operators already have such first lattice pieces, so that they need not buy new lattice pieces for the lattice mast crane of the invention. The cross-beams correspondingly have at least two smaller first connecting regions to the first lattice pieces of the at least two in particular parallel strands and on the side opposite the first connecting regions a second larger connecting region to the pivot piece and to the head piece. Due to doubling, the smaller first lattice pieces nevertheless provide an extremely stable lattice mast, which of course is correspondingly shorter. Since a great boom length is not required for every use, but frequently cases of use occur, in which heavy loads must be moved with small outreaches, it is not necessary in such cases to resort to a more powerful crane as in the prior art, but there can be used an already existing lattice mast crane with the more stable lattice mast boom constructed in accordance with the invention.

Advantageously, the first lattice pieces can be pushed into the second lattice pieces for transport purposes. In this way, the transport volume can be reduced considerably.

As an alternative to using the smaller lattice pieces from the luffing jib for the first region and the larger lattice pieces of the main boom for the second region it is also possible to use the same lattice pieces for the first and the second region, e.g. lattice pieces from the main boom, which thereby is of course also shortened correspondingly.

In accordance with the invention, a new, stronger and of course shorter lattice boom can be produced by combining various already existing lattice pieces of a long lattice boom in parallel.

In accordance with the invention, it is not absolutely necessary to provide second lattice pieces in the second region, but the same rather can also consist of the pivot piece or head piece alone, which then is directly connected with the corresponding cross-beam. In this way, too, a lattice mast boom, which then completely consists of at least two first strands of interconnected first lattice pieces, which in particular extend in parallel in longitudinal direction of the boom, can be used on an already existing lattice mast crane, on which otherwise a lattice mast boom with only one strand of interconnected lattice pieces is pivotally mounted. To increase the boom length, only one strand of a number of second lattice pieces corresponding to the required length then is provided in the second region, if necessary.

Therefore, the present invention furthermore comprises a lattice mast crane with a lattice mast boom to be luffed up in a vertical luffing plane, which comprises a pivot piece, a plurality of lattice pieces releasably connectable with each other, and a head piece, wherein the lattice mast boom includes only one pivot piece and/or only one head piece in accordance with the invention, and wherein in a first region the lattice mast boom includes at least two first strands of interconnected first lattice pieces, which are connected with the one pivot piece via a lower cross-beam and/or with the one head piece via an upper cross-beam.

If only one pivot piece is used, the lattice mast of the invention can be used on the basic machine of a known lattice mast crane, without having to change the attachment of the lattice mast boom to the crane. If only one head piece is used, the hoisting mechanism of the lattice mast crane need not be changed, since the load still can be lifted via the already existing hoisting winch of the lattice mast crane. Advantageously, only one pivot piece and only one head piece are used, so that an existing basic machine can be used with the lattice mast boom of the invention without any constructive modification. The lattice mast boom then can comprise either only the first region with two strands of lattice pieces or the first region with two strands and, as described already, a second region with only one strand of lattice pieces. The first strands in turn advantageously extend in parallel in longitudinal direction of the boom.

Here again it only is necessary to buy the lower cross-beam and the upper cross-beam, in order to assemble a more stable lattice mast boom from already existing lattice pieces.

The cross-beams have at least two first connecting regions to the first lattice pieces of the at least two in particular parallel strands and on the side opposite the first connecting regions exactly one second connecting region to the pivot piece or to the head piece. Advantageously, the second connecting region is arranged centrally with respect to the first connecting regions. The cross-beams advantageously can releasably be connected with, in particular be bolted to the pivot piece or the head piece via their second connecting region. Alternatively, the cross-beams can also be firmly connected with the pivot piece or the head piece, so that head piece and upper cross-beam and/or pivot piece and lower cross-beam each form a unit.

The first lattice pieces either can correspond to the large lattice pieces usually employed for the main boom, or to the small lattice pieces usually employed for the luffing jib. The second connecting region of the lower and upper cross-beams to the pivot piece or to the head piece correspondingly either has the same size as the first connecting regions to the first lattice pieces of the at least two in particular parallel strands, or is greater than the first connecting regions.

Quite obviously, such cross-beams, which each connect exactly one head piece and/or pivot piece with the at least two first strands, can be employed with the same advantages also in combination with a second region of only one second strand of interconnected second lattice pieces.

For an optimum dissipation of force, the lattice mast boom in accordance with the invention advantageously is constructed substantially symmetrically with respect to the luffing plane extending through the middle axis of the lattice mast boom.

Advantageously, it is provided that the middle axes of two parallel first strands have the same distance from the middle axis of the second strand and/or of the pivot piece and/or of the head piece. Hence, the middle axes of two parallel first strands advantageously have the same distance from the middle axis of the entire lattice mast boom. With this arrangement it is ensured that the two strands substantially are loaded equally and thus optimally contribute to an increase in stiffness. If the first strands do not extend parallel to each other, but at a certain angle with respect to each other, the middle axes of two first strands correspondingly extend symmetrically with respect to the middle axis of the second strand and/or of the pivot piece and/or of the head piece. The first lattice pieces and the second lattice pieces advantageously include a plurality of, in particular four, parallel longitudinal struts, wherein the middle axis is defined by the fact that it extends parallel to the longitudinal struts and has the same distance to all longitudinal struts. If more than two parallel first strands of first lattice pieces are used, the lattice mast boom advantageously includes one or more groups of parallel strands, whose middle axes have the same distance from the middle axis of the second strand and/or of the pivot piece and/or of the head piece. Furthermore, one of the first strands can be arranged such that its middle axis coincides with the middle axis of the second strand and/or of the pivot piece and/or of the head piece.

Advantageously, the distance of the middle axes of the two parallel first strands at least corresponds to the width of the second strand and/or of the pivot piece and/or of the head piece, in particular exactly to the width of the second strand. This results in an optimum introduction of force from the first strands into the second strand, wherein the cross-beams substantially can be constructed of force triangles.

Furthermore advantageously, the distance between the opposed inner surfaces of two first strands on the lower and/or upper cross-beam substantially corresponds to the width of the second strand and/or of the pivot piece and/or of the head piece. As a result, the respectively two inner longitudinal struts of the first lattice pieces substantially extend in the planes spanned by the corresponding longitudinal struts of the second strand and/or of the pivot piece and/or of the head piece, so that in the first region the respectively two inner longitudinal struts approximately are aligned with the longitudinal struts in the second region.

Furthermore advantageously, the width of the first strands advantageously each is smaller than that of the second strand and/or of the pivot piece and/or of the head piece. The same correspondingly is true for the connecting regions of the cross-beams.

Furthermore advantageously, the two in particular parallel first strands are arranged laterally one beside the other, so that the width of the lattice mast boom, which is measured vertical to the luffing plane, is increased. Correspondingly, the middle axes of the two in particular parallel first strands advantageously span a plane which is vertical to the luffing plane.

Advantageously, the in particular parallel first strands in accordance with the invention are arranged symmetrically with respect to the second strand and/or to the pivot piece and/or to the head piece. By means of such a symmetrical arrangement with respect to the middle axis of the lattice mast boom of the invention, the particularly good stiffness and dissipation of forces as described above is obtained. Advantageously, the luffing plane forms the plane of symmetry.

Advantageously, the first lattice pieces of the invention have a rectangular cross-section with a longer side and a shorter side, wherein the shorter side is arranged vertical to the luffing plane. While for lattice mast booms with only one strand, the longer side usually is arranged vertical to the luffing plane, in order to increase the width of the lattice mast boom, the width of the lattice mast boom in accordance with the invention can be increased by using at least two in particular parallel strands, so that the longer side can be used to increase the bending stiffness in the luffing plane. Furthermore, advantages are obtained when the first lattice pieces have a smaller cross-section than the second lattice pieces, as in this way the thickness of the lattice mast boom measured parallel to the luffing plane in the first region does not differ so much from the corresponding thickness in the second region.

Furthermore advantageously, the second lattice pieces have a rectangular cross-section with a longer and a shorter side, wherein the longer side is arranged vertical to the luffing plane. This results in a greater width also in the second region, and also in a smaller difference in thickness of the lattice mast boom parallel to the luffing plane between the first and the second region. Particular advantages are obtained when the shorter side of the first lattice pieces is arranged vertical to the luffing plane, whereas the longer side of the second lattice pieces is arranged vertical to the luffing plane.

As already described, the lattice mast boom of the invention advantageously is constructed of standard lattice pieces, as they are also used for constructing a lattice boom with only one strand of lattice pieces. In accordance with the invention, the lattice mast crane advantageously is operable by using the pivot piece and the head piece also with a lattice boom of only one strand of lattice pieces, in particular of two lattice pieces. Advantageously, the upper cross-beam correspondingly has the same second connecting region to the head piece as the pivot piece and/or the lower cross-beam has the same second connecting region to the pivot piece as the head piece.

In particular, the lattice boom of the invention is configured such that the two cross-beams and the first region with the two in particular parallel first strands can be removed, and from the remaining parts of the lattice boom a lattice boom with only one strand of second lattice pieces can be formed, in particular in that the second lattice pieces can also directly be connected with the pivot piece and/or the head piece. For extending the lattice boom, further second lattice pieces can of course also be used.

Furthermore advantageously, the first lattice pieces removed during completion of the second region can be used for constructing an upper region of the lattice boom, in particular for constructing a luffing jib. Since this region is loaded less, lattice pieces with a smaller cross-section are used here already as a standard, which now are used in accordance with the invention for constructing the first region with two in particular parallel strands or just for the luffing jib.

The lattice mast boom in accordance with the invention can of course also have a luffing jib, in particular a luffing jib which is composed of first lattice pieces. By providing the first region with two strands, and with the same number of lattice pieces, the length of the luffing jib and hence the length of the entire lattice mast boom is smaller than if all first lattice mast pieces were used for constructing the luffing jib as in the prior art.

The lattice mast boom in accordance with the invention hence increases the flexibility and lifting capacity of already existing lattice mast cranes with only a minimum of additional investment costs. In particular, already existing lattice mast cranes can be used, as they are already known from the prior art, and the lifting capacity can be increased by buying the two cross-beams in addition.

In the lattice mast crane of the invention, only one hoisting cable and/or one hoisting winch advantageously are used for lifting the load. Other than in the case of two lattice mast booms used in parallel, the hoisting assembly on the lattice mast crane hence need not be doubled. In addition, the bracing, the derrick boom and all further elements need not be adapted either, but can be used unchanged.

In accordance with the invention, at least one intermediate cross-beam furthermore can be used within the first region for connecting the at least two first strands advantageously extending in parallel in longitudinal direction of the boom. In this way, the stability of the first region can be increased once again, in particular when the same has a great length.

Furthermore advantageously, the lattice mast crane of the invention is a crane with a basic machine comprising an undercarriage and an uppercarriage, wherein the uppercarriage is rotatably arranged on the undercarriage about a vertical axis, and the lattice mast boom is pivotally mounted on the uppercarriage so as to be luffed up about a horizontal axis.

Furthermore advantageously, the lattice mast crane of the invention is a traveling crane, in particular a crane which is movable via tracked traveling gears.

Furthermore advantageously, the lattice mast crane of the invention includes a derrick boom, via which the lattice mast boom is braced. In general, by bracing in the luffing plane a higher stability of the lattice mast boom is achieved in the luffing plane, so that the deflection of the boom in this plane is not the limiting factor for the lifting capacity of the boom.

Beside the lattice mast crane, the present invention furthermore comprises a lattice mast boom for a corresponding lattice mast crane of the invention. Such lattice mast boom includes a pivot piece, a plurality of lattice pieces releasably connectable with each other, and a head piece, and in accordance with the invention it is characterized in that it includes a first and a second region, wherein in the first region at least two first strands of interconnected first lattice pieces are provided, which are connected with the pivot piece via a lower cross-beam and with the head piece via an upper cross-beam, and wherein in the second region the lattice mast boom only consists of a second strand of interconnected second lattice pieces. Alternatively or in addition, the lattice mast boom of the invention furthermore is characterized in that the lattice mast boom includes only one pivot piece and/or only one head piece, wherein in the first region the lattice mast boom includes at least two parallel first strands of interconnected first lattice pieces, which are connected with the one pivot piece via a lower cross-beam and/or with the one head piece via an upper cross-beam. The lattice mast booms of the invention quite obviously provide the same advantages as they have already been described with respect to the lattice mast cranes.

The advantageous embodiments of the lattice mast boom of the invention correspond to the advantageous embodiments of the lattice mast cranes of the invention, so that a repetition of the corresponding embodiments can be omitted.

The present invention furthermore comprises a lower or an upper cross-beam for a lattice mast crane as described above, or for a lattice mast boom as described above. In particular, such cross-beam includes at least two first connecting regions to first lattice pieces and a second connecting region to a pivot piece and/or to a head piece and/or to a second lattice piece. The cross-beams advantageously can releasably be connected with, in particular bolted to the first lattice pieces via the first connecting regions. Furthermore, the cross-beams are connected or connectable with the pivot piece or the head piece via the second connecting region. Advantageously, the cross-beams can releasably be connected with, in particular bolted to the pivot piece or the head piece via their second connecting region. In this way, existing head or pivot pieces still can be used.

Alternatively, the cross-beams can firmly be connected with the pivot piece or the head piece. In this way, the head piece would be integrated in the upper cross-beam and the pivot piece would be integrated in the lower cross-beam, so that the cross-beams would replace the usual pivot and head pieces.

Advantageously, the first connecting regions are located on one side of the cross-beam, whereas the second connecting region is arranged on the opposite side of the cross-beam. In accordance with the invention, there is provided only one second connecting region to the pivot piece and/or head piece and/or second lattice piece, wherein the at least two first connecting regions advantageously are arranged symmetrically with respect to said one first connecting region. Alternatively or in addition, it can be provided in accordance with the invention that the first connecting regions to the first lattice pieces have a smaller cross-sectional area than a second connecting region to the pivot piece or head piece or second lattice piece.

Furthermore, the orientations and proportions in size of the first lattice pieces and second lattice pieces described with respect to the lattice mast crane correspondingly apply to the connecting regions of the cross-beams. The plurality of first connecting regions advantageously are constructed identically. Advantageously, the first connecting regions are arranged such that the first strands connectable therewith extend in parallel. Furthermore advantageously, two first connecting regions have the same distance to the second connecting region, so that a symmetrical arrangement is obtained.

A connecting region advantageously consists of a plurality of, in particular four, connecting points, to which the longitudinal struts of a lattice piece can be attached. Middle axis of such connecting region hence is understood to be an axis vertical to the plane defined by these connecting points, which has the same distance to all connecting points. The center of a connecting region correspondingly is defined as the intersection of the middle axis with the plane defined by the connecting points.

Advantageously, the planes each defined by the connecting points of the first connecting regions are arranged parallel to each other, so that the corresponding middle axes also extend in parallel. In particular, the connecting points of all first connecting regions lie in one common plane. Furthermore advantageously, the planes defined by the connecting points of the first connecting regions are arranged parallel to the plane defined by the second connecting region.

Advantageously, the middle axes of two first connecting regions have the same distance to the middle axis of the second connecting region or are arranged symmetrically with respect to the same. Furthermore advantageously, the distance of the centers of two first connecting regions at least corresponds to the width of the second connecting region measured in the plane which is spanned by the two middle axes of the first connecting regions.

There are obtained two alternative, particularly advantageous embodiments: In a first embodiment, the distance of the centers of two first connecting regions substantially corresponds to the width of the second connecting region, so that the centers or middle axes of the two first connecting regions each are located opposite a side region of the second connecting region. Alternatively, the distance between the opposed inner surfaces of two first connecting regions substantially corresponds to the width of the second connecting region, so that the two inner connecting points of the first connecting regions each are located opposite a side region of the second connecting region. This results in a particularly good introduction of force from the first connecting regions to the second connecting region. However, embodiments with another distance between the first connecting regions also are conceivable, which distance advantageously lies between the two described alternatives.

Furthermore advantageously, the first connecting regions and the second connecting regions each have a rectangular cross-section with a longer and a shorter side, wherein the longer side of the first connecting regions is arranged parallel to the shorter side of the second connecting region. Again, this provides for an optimum transmission of force.

The second connecting region of the lower cross-beam advantageously is configured such that it is directly connectable with the boom-side connecting region of the pivot piece. The second connecting region of the upper cross-beam, however, advantageously is configured such that it is directly connectable with the boom-side connecting region of the head piece. Accordingly, the second connecting region of the upper cross-beam advantageously corresponds to the connecting region of the pivot piece, whereas the second connecting region of a lower cross-beam corresponds to the connecting region of the head piece. Accordingly, the first connecting regions of the lower and the upper cross-beam each are counterparts, so that the first connecting regions of the lower cross-beams are connectable with the lower connecting region of a first lattice piece, whereas the first connecting regions of an upper cross-beam are connectable with the upper connecting region of a first lattice piece.

The upper and the lower cross-beam each can be formed in one piece. Alternatively, however, the same can also be composed of a plurality of segments, which in particular can be bolted to each other. This becomes necessary when the admissible transport dimensions would be exceeded by a one-piece cross-beam.

The present invention furthermore comprises a set, which includes a lower and an upper cross-beam as described above. Such set can be bought by a crane operator, in order to construct a lattice mast boom of the invention with existing lattice pieces.

Furthermore advantageously, the set further includes first and/or second lattice pieces. With such a set, a crane operator then correspondingly can construct longer lattice mast booms.

Furthermore, the set in accordance with the invention advantageously includes a pivot piece and/or a head piece. In this way, a completely new lattice mast boom in accordance with the invention possibly can also be constructed.

Furthermore advantageously, the set in accordance with the invention includes at least one intermediate cross-beam. By means of such intermediate cross-beams, the stability of the first region can be increased.

As far as the respective cross-beam is composed of several parts, it can consist of especially constructed parts. Alternatively, however, slightly modified lattice pieces from the previous main boom, thus the lattice pieces from the second region, can also be used. Here, the bolting tabs for further assemblies then can be mounted in addition.

In a modified embodiment, the pivot piece can be connected with the cross-beam or various assemblies of the cross-beam and be configured as one assembly.

The pivot piece can be the standard pivot piece. However, it could also be a separately constructed pivot piece.

BRIEF DESCRIPTION OF THE DRAWINGS

The invention will now be explained in detail with reference to an embodiment and the drawings, in which.

DESCRIPTION OF THE PREFERRED EMBODIMENTS

Figure 1A:
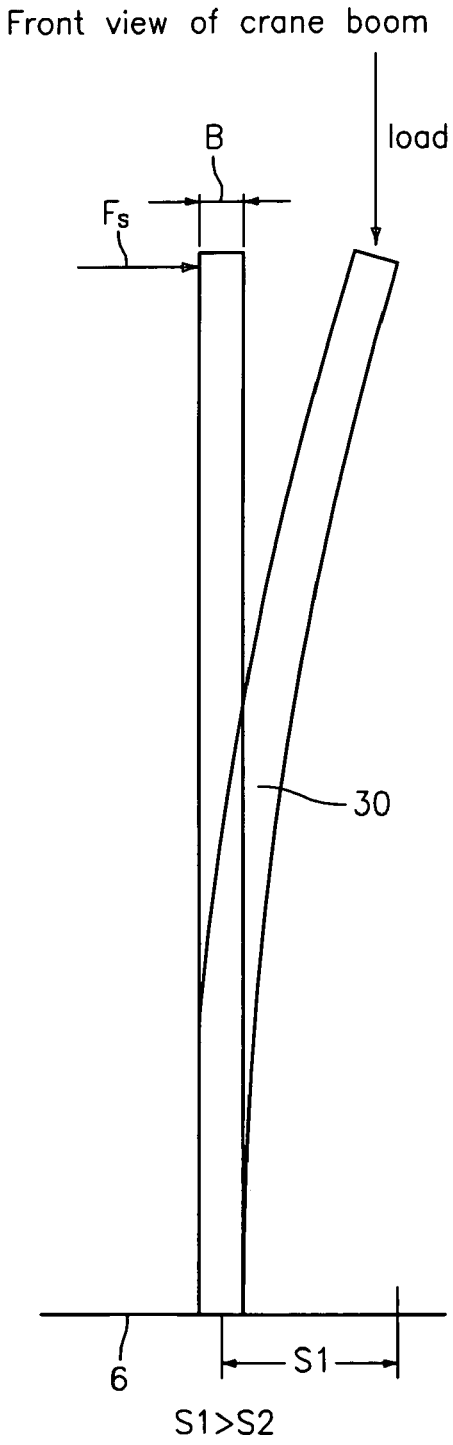
FIGS. 1*a*, 1*b*: show schematic front views of lattice booms to explain the basic problems underlying the present invention.
Figure 1B:
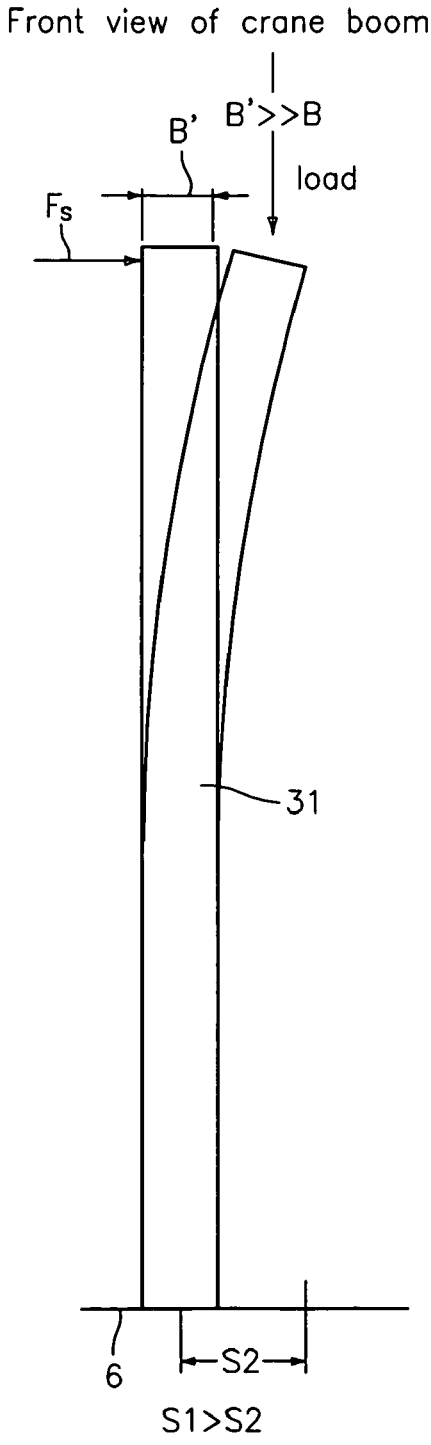

The basic problems of the invention as shown in FIGS. 1*a* and 1*b*, according to which for increasing the lifting capacity in particular with steep boom positions the width of the boom must be increased to increase the lateral stability of the boom, has already been described in detail above.

Figure 2A:
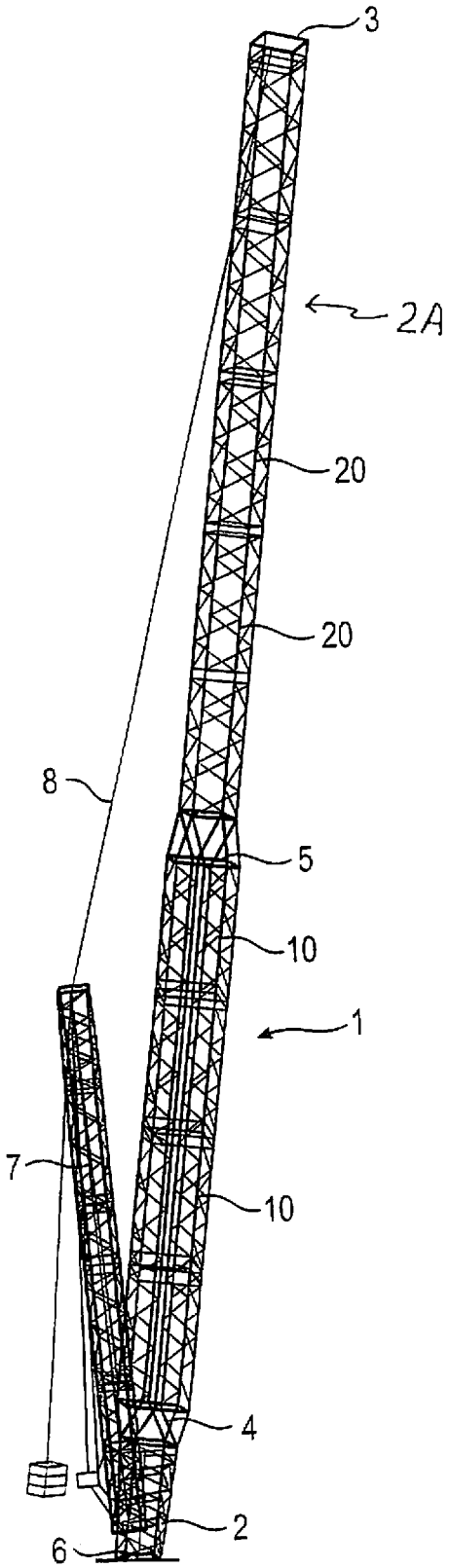
FIG. 2*a*: shows a perspective view of an embodiment of the lattice mast boom of the invention.
Figure 2B:
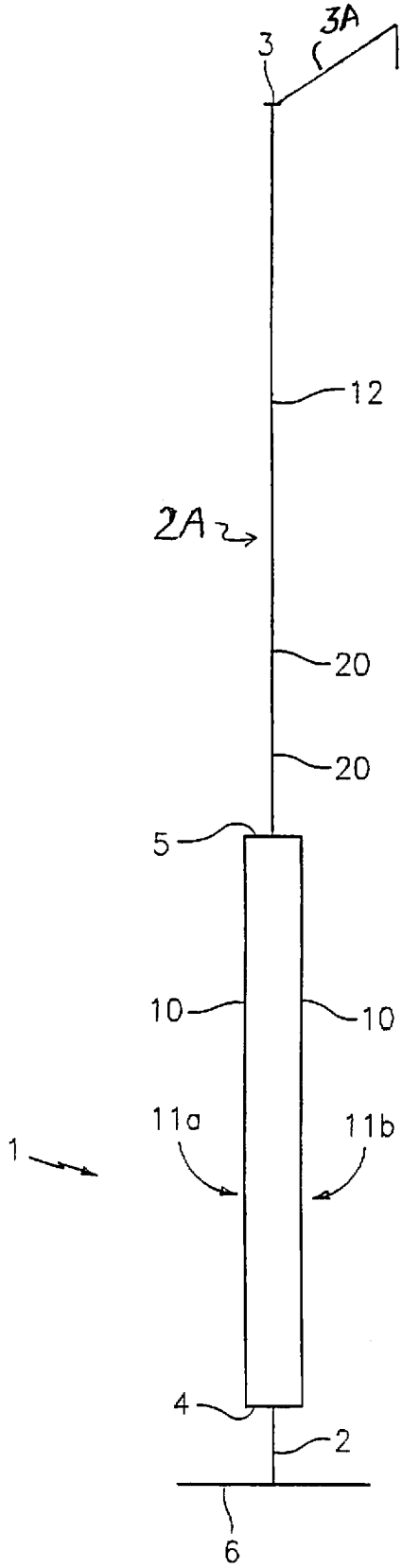
FIG. 2*b*: shows a basic diagram of the embodiment of the lattice mast boom of the invention.

The embodiment of a lattice mast boom of the invention as shown in FIGS. 2*a* and 2*b* now includes a first region 1 and a second region 2A, wherein in the first region 1 the lattice mast boom consists of two first strands 11*a* and 11*b* of interconnected first lattice pieces 10, which are connected with a pivot piece 2 via a lower cross-beam 4 and with a head piece 3 via an upper cross-beam, wherein in the second region 2A the lattice mast boom only consists of a second strand 12 of interconnected second lattice pieces 20. The first strands 11*a* and 11*b* extend parallel to each other in longitudinal direction of the boom. A luffing jib 3A is optionally connected to head piece 3.

The first lattice pieces 10 are geometrically identical components, which are bolted to each other to form a strand of lattice pieces. The second lattice pieces 20 also are geometrically identical components, which are bolted to each other to form a strand of lattice pieces. The first lattice pieces 10 all have the same dimensions and connecting regions. In terms of shape, however, the same can be different. For instance, lattice pieces 10 which are mounted further up can have a smaller wall thickness in the used tubes than those lattice pieces 10 which are mounted further down in the boom. In continuation of this idea, the lattice pieces arranged at the bottom also can have additional stiffenings. Advantageously, the individual lattice pieces then are marked correspondingly, and the customer gets information as to where he should mount which lattice piece. A similar procedure applies to the second lattice pieces 20.

In accordance with the invention, the second strand 12 is arranged above the strands 11*a* and 11*b*, so that the upper cross-beam 5 connects the first strands 11*a* and 11*b* with the second strand 12, and the head piece 3 is arranged at the top of the second strand 12. By using two parallel strands 11*a* and 11*b* in the first region, the total width of the lattice mast boom can be increased there as compared to the second region, so that an increased lateral stability is obtained. The first region is arranged at the bottom, since the boom is loaded more in the lower part than in the upper part.

The lattice mast boom of the invention only includes a pivot piece 2 and a head piece 3, and like any ordinary lattice mast boom with only one strand of interconnected lattice pieces hence can be attached to the already existing basic machine of a lattice mast crane via the one pivot piece 2. The horizontal luffing axis 6, via which the lattice mast boom of the invention is attached to the basic machine so as to be luffed up in a vertical luffing plane, is illustrated in the drawing as axis 6. The two first strands 11*a* and 11*b* are arranged one beside the other with respect to this luffing axis 6, so that the width of the boom measured vertical to the luffing plane or parallel to the luffing axis 6 is increased in the first region 1. The construction of the first region 1 is symmetrical with respect to the luffing plane extending through the middle axis of the main boom.

Figure 3A:
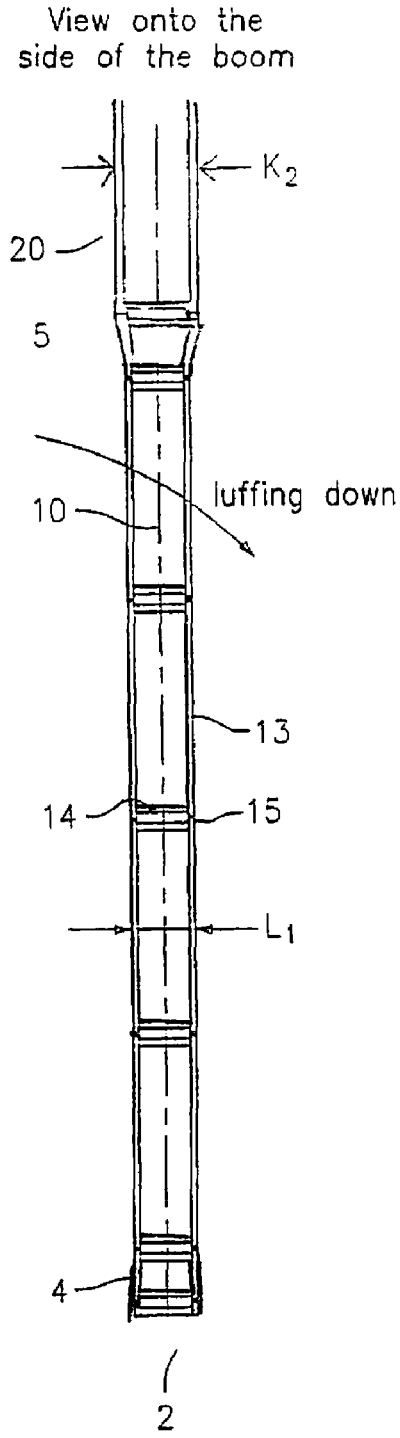
FIG. 3*a*: shows a side view of a part of the lattice mast boom of the invention.
Figure 3B:
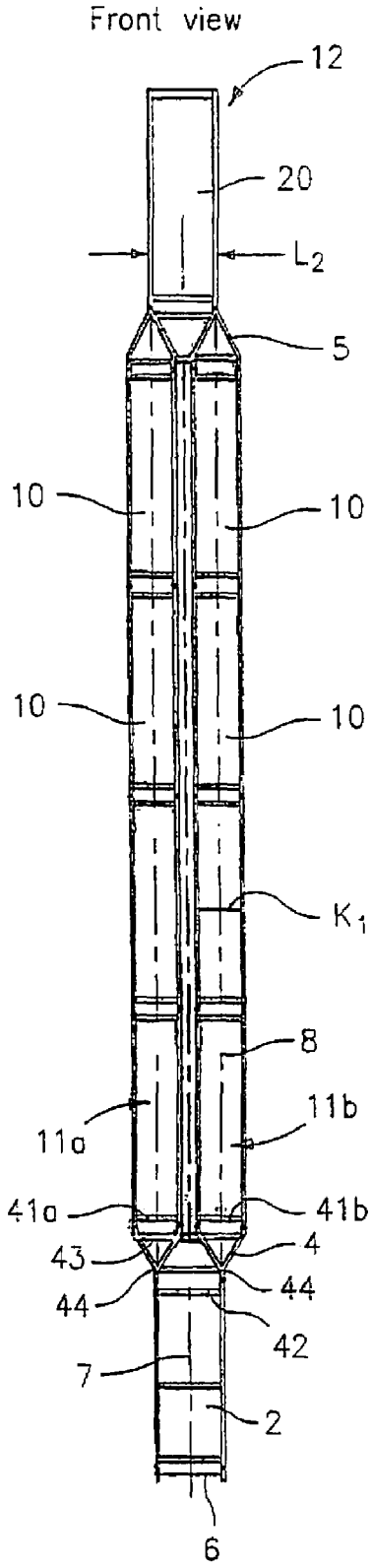
FIG. 3*b*: shows a front view of the part of an embodiment of the boom of the invention which is shown in FIG. 3*a*.
Figure 3C:
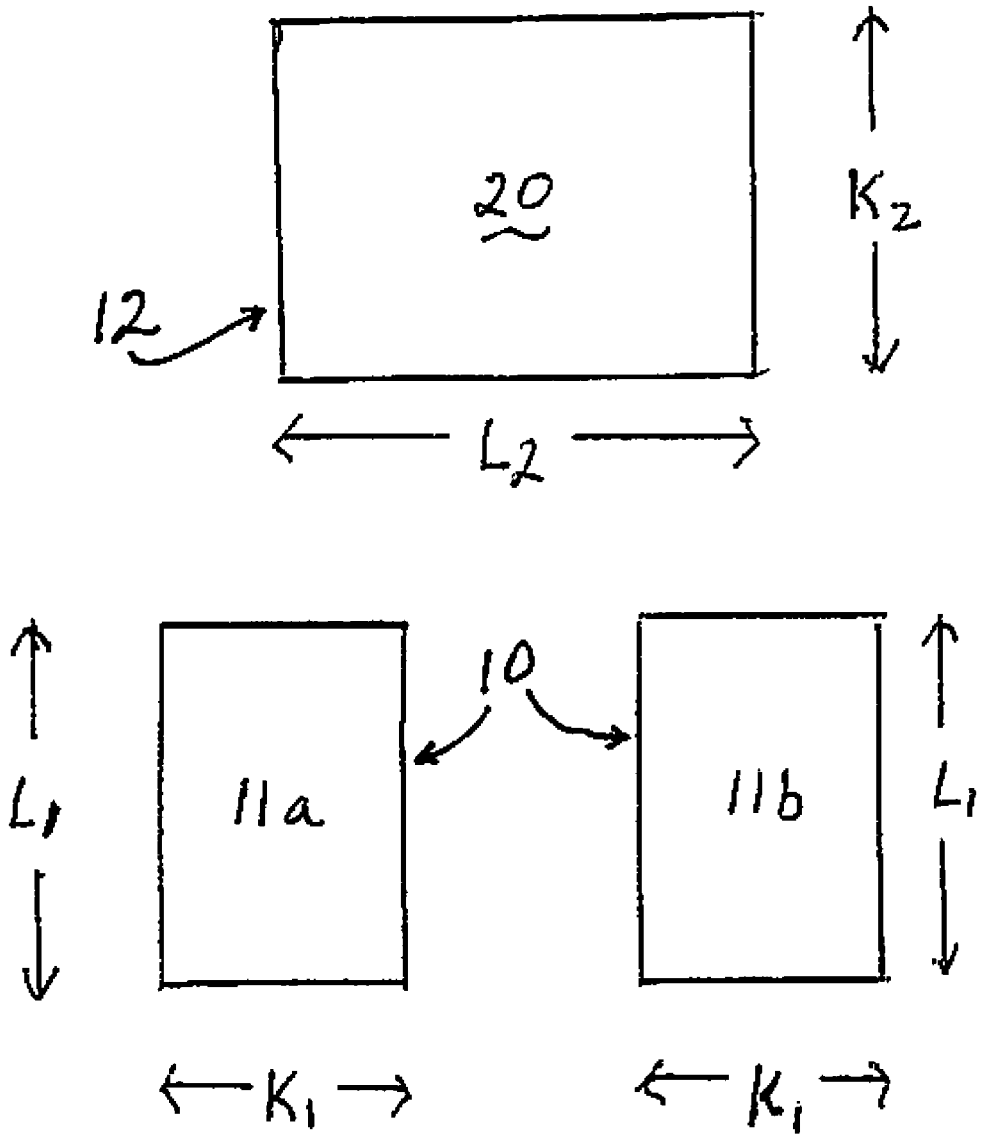
FIG. 3*c*: shows cross-sectional views of the first and second lattice pieces.
Figure 4B:
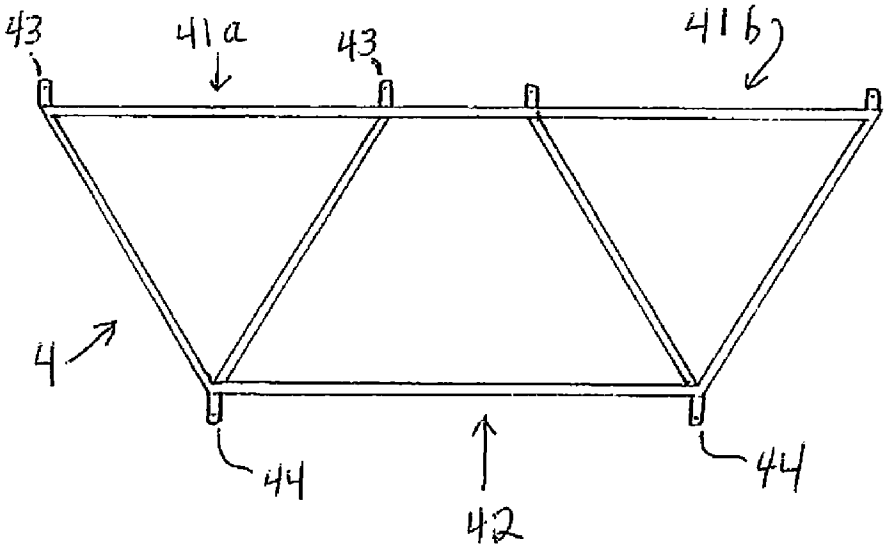
FIGS. 4*a*, 4*b*, and 4*c* are, respectively, side, front, and perspective views of the lower cross-beam.
Figure 4A:
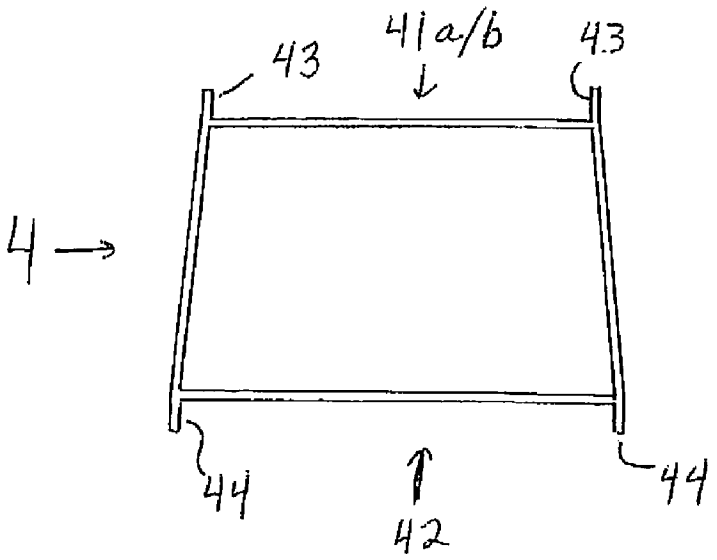
Figure 4C:
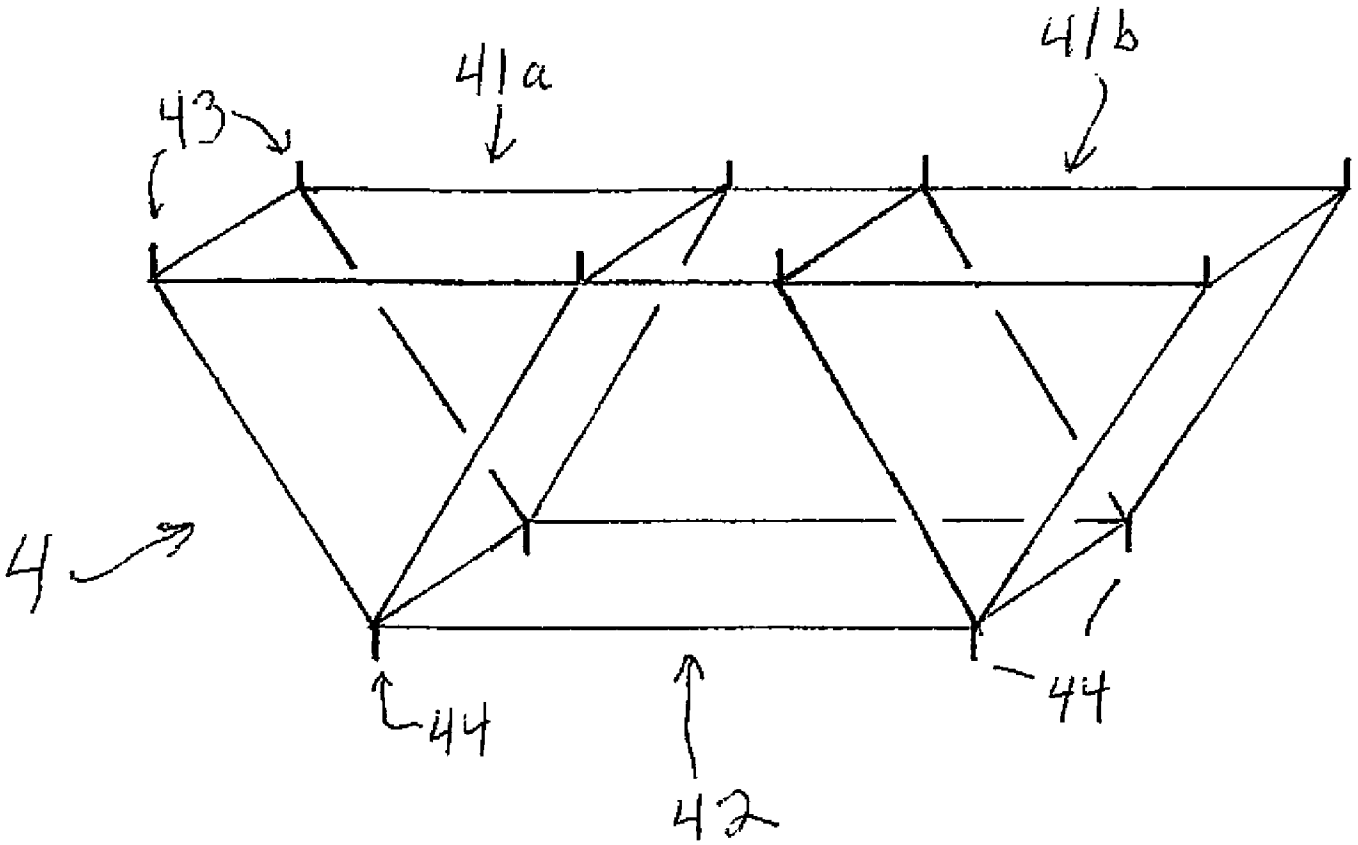

The exact construction of the lattice pieces, the cross-beams and the lattice mast boom of the invention is again shown in greater detail in FIGS. 3*a* and 3*b*, wherein FIG. 3*a* shows a side view of the lattice boom, so that the drawing plane corresponds to the luffing plane of the boom, whereas FIG. 3*b* shows a front view of the lattice mast boom, so that the drawing plane is vertical to the luffing plane, which extends along line 7 in FIG. 3*b*.

The first lattice pieces 10 and the second lattice pieces 20 have a rectangular cross-section. Each lattice piece comprises four longitudinal struts 13, which in their terminal regions are connected via cross struts 14. Furthermore, as shown in FIG. 2*a*, further bracing elements are provided, in order to produce a construction of force triangles. In their terminal regions, the lattice pieces furthermore have connecting points via which they can be bolted to each other and to the cross-beams. The connecting points are located in the corners of the rectangular cross-sectional area in the terminal region of the longitudinal struts.

The first lattice pieces 10 have a smaller cross-sectional area than the second lattice pieces 20 and thus can be pushed into the same for transport purposes. Such lattice pieces are known already, but usually the large lattice pieces 20 are used for constructing the main boom and the smaller lattice pieces 10 are used in regions of the boom which are loaded less, such as at the outer end of the luffing jib. The lattice pieces 10 and 20 each have a rectangular cross-section with a longer side and with a shorter side. In accordance with the invention, the cross-beams now are designed such that the longer side L1 of the first lattice pieces is arranged parallel to the shorter side K2 of the second lattice pieces. As is clearly shown in FIG. 3*a*, the thickness of the lattice boom measured in the luffing plane at the transition from the first region into the second region is only slightly changed thereby, so that a good transmission of force is obtained, since the length of the longer side L1 of the first lattice pieces substantially corresponds to the length of the shorter side K2 of the second lattice pieces.

As can be taken from FIG. 3*b*, the total width of the lattice mast boom in the first region 1, measured in a plane vertical to the luffing plane, is greater than in the second region, wherein the total width in the first region is formed by the widths of the two first strands 11*a* and 11*b* and their distance from each other. The lattice mast boom is formed such that the middle axes 8 of the first strands 11*a* and 11*b* extend in the planes formed by the lateral surfaces of the lattice pieces 20, i.e. the distance of the middle axes corresponds to the width L2 of the second lattice pieces 20. This provides for an optimum introduction of force from the first region into the second region. The distance of the first strands can, however, also be increased. Advantageously, the distance between the opposed inner surfaces of the two first strands 11*a* and 11*b* is chosen such that it corresponds to the width of the second strand, so that the inner lateral surfaces of the two first strands substantially are aligned with the lateral surfaces of the second strand. The respectively inner longitudinal struts of the first strands also are approximately aligned with the longitudinal struts of the second strand, since the first strands 11*a* and 11*b* are located at such a distance from each other that the inner longitudinal struts of the lattice pieces 10 are connected directly below the longitudinal struts of the lattice pieces 20.

The lower cross-beam 4 and the upper cross-beam 5 each have two connecting regions 41*a* and 41*b* arranged one beside the other for connection with the first strands 11*a* and 11*b*. On the opposite side, they have a second connecting region 42 for connection either with the pivot piece 2 or with the second strand 20. The connecting regions are configured such that the middle axes of the respective lattice pieces extend parallel to each other. Each connecting region is formed by four connecting points, via which the cross-beam can be bolted to the respective boom piece. The first connecting region 41*a* has connecting points 43, the second connecting region 42 connecting points 44. The cross-beams can be made in one piece or, to reduce the transport size, of several pieces, i.e. of several segments which can be bolted to each other.

In the illustrated embodiment, two connecting points 43 of the first connecting region 41*a*, which are located one beside the other in width direction of the cross-beam, are connected with each other via a cross strut, and via one longitudinal strut each with a bolting point 44 of the second connecting region 42, so that a force triangle is formed from the two bolting points 43 of the first connecting region 41*a* and the connecting point 44 of the second connecting region 42. The corresponding bolting points of the further first connecting region 41*b*, which are arranged one beside the other in width direction of the cross-beam, correspondingly are connected with each other and via two longitudinal struts with the one further connecting point 44 of the second connecting region 42. The force triangles formed thereby lie one beside the other in a common plane in width direction, wherein the inner corners of the force triangles facing each other on sides of the first connecting regions and the tips of the force triangles on sides of the second connecting region in width direction each are connected via a cross strut. As can be taken from FIG. 3*a*, the force triangles in height direction each are connected with each other via further cross struts, so that a trapezoid is obtained.

By means of the lattice mast boom of the invention, the lifting capacity of an existing lattice mast crane can be increased by buying only few additional parts, the lower cross-beam 4 and the upper cross-beam 5. There can be used an already existing basic machine of a lattice mast crane, to which as usual only one boom can be attached via only one pivot piece and only one hoisting winch is provided for lifting the load. The basic machine usually consists of an uppercarriage, to which the boom is attached and which is rotatably mounted on an undercarriage about a vertical axis of rotation. On the undercarriage, a traveling gear, in particular a tracked traveling gear, usually is arranged, so that the lattice mast crane is movable.

For the lattice mast boom, already existing material likewise can be used in the form of the pivot piece, the first and second lattice pieces and the head piece. The pivot piece 2 can be pivotally mounted on the basic machine of the lattice mast crane via the pivot axis 6, and on the boom side can be connected as requested with the second lattice pieces or with the lower cross-beam, so that an existing boom with only one strand of lattice pieces 20 connected with each other in longitudinal direction of the lattice boom can be converted into a boom in accordance with the invention. The head piece 3 is connectable with the second lattice pieces and usually carries the pulley head, over which the hoisting cable is guided for lifting the load. On the uppermost lattice piece of the second region 2, there can also be arranged a luffing jib, which then advantageously is at least partly constructed of first lattice pieces 10.

The construction of the lattice mast boom of the invention of already existing elements and new elements will now again be outlined. The lattice mast boom of the invention comprises:

1. an existing pivot piece 2 (if necessary, a reinforced pivot piece might be used here, wherein the point limiting the lifting capacity in a boom usually is not the pivot piece, but one of the succeeding lattice pieces, so that usually the already existing pivot piece can be used),
2. the new lower cross-beam 4, which forms a rigid connection between the pivot piece 2 and the double boom portion 1,
3. existing first lattice pieces 10 with small cross-section (from the luffing jib), from which the two first, parallel strands 11*a* and 11*b* are composed,
4. possibly intermediate cross-beams in the vicinity of the parallel boom regions, in order to connect the first strands 11*a* and 11*b* with each other (these intermediate cross-beams likewise would have to be bought in addition),
5. the new upper cross-beam 5, which forms a rigid connection between the double boom portion 1 and the second lattice pieces 20 of greater cross-section of the main boom,
6. existing lattice pieces 20 of greater cross-section from the main boom,
7. the existing head piece.

Hence, merely two new elements, the lower cross-beam 4 and the upper cross-beam 5, are required. Alternatively, there might also be used a lower cross-beam in which a pivot piece already is integrated, so that the lower cross-beam performs the functions of the pivot piece shown in the embodiment and of the lower cross-beam shown in the embodiment and hence replaces the usual pivot piece. If the second strand is omitted, the upper cross-beam and the head piece might also form a unit which replaces the usual head piece.

Quite an essential advantage of the present invention furthermore consists in that the existing elements of the lattice mast crane, such as the derrick boom, the bracing trestles, the head piece or the hook flanges, can also be utilized without any change for the heavy-lift boom in accordance with the invention. No new attachment to the basic machine of the crane and no double pulley head on the outer end of the boom with correspondingly doubled hoisting winches must be used, since the lattice mast boom of the invention is used with only one pulley head.

The lattice mast boom of the invention is constructed of the weaker lattice pieces 10 of the luffing jib, but the same are mounted in parallel, so that a higher moment of inertia and resistance is obtained in particular with respect to the lateral loads as compared to the usual main boom. Since the lattice pieces have a rectangular (and no square cross-section), the lattice pieces 10 mounted in the boom in parallel basically can be used in two ways. In accordance with the invention, however, the broad lateral surface of the first lattice pieces 10 is arranged parallel to the luffing plane of the boom. The two narrow sides of the first lattice pieces 10 and the distance between the parallel strands then form the area vertical to the luffing plane, which defines the lateral stiffness. This improves the flux of force, as in this way the narrow side of the second lattice pieces with the greater cross-section is connected with the broader side of the first lattice pieces via the upper cross-beam.

An operation with luffing jib is of course also possible, wherein e.g. the lattice elements not required for constructing the first regions can be used. The length of the luffing jib hence is of course reduced by the lattice pieces used in the first region in the lattice boom of the invention. Further lattice pieces can of course also be bought, in order to increase the length of the lattice boom.

As an alternative to the illustrated embodiment, other configurations are also conceivable, in which the first region with the two parallel strands is not constructed of lattice elements of the luffing jib, but like the lattice pieces of the second region is constructed of lattice elements of the main boom. Correspondingly, the first and the second connecting region of the cross-beams then have the same size, so that identical parts can be used for the first and second lattice pieces. In such an arrangement, the length of the lattice mast boom of the invention of course is reduced corresponding to the size of the first region, in which two parallel boom strands are used.

It is likewise conceivable to completely omit lattice pieces in the second region of the lattice mast boom and use all lattice pieces for constructing the first region with the two parallel strands. As compared to the usual main boom with only one strand, the length of the boom hence is reduced to half, but there is obtained an extremely stable boom with a very high lifting capacity. The head piece can directly be mounted onto the upper cross-beam. It is likewise conceivable to directly mount the luffing jib on the upper cross-beam.

In any case, an unproblematic retrofittability is obtained by the present invention. The crane operators for instance can increase the lifting capacity of their cranes with manageable costs, since merely two new assemblies are required.

Each crane includes a limit load table against overload, which is monitored by the control. If the limitation of the admissible limit load only is caused by the boom, a stronger, but shorter lattice boom in accordance with the invention can be achieved by means of the parallel combination of various existing lattice pieces of a long lattice boom via the two cross-beams in accordance with the invention. The admissible limit load tables of the crane control must of course be adapted to the lattice mast boom of the invention.

The invention claimed is:

1. A lattice mast crane with a lattice mast boom to be luffed up in a vertical luffing plane, which comprises a pivot piece, a plurality of lattice pieces releasably connectable with each other, and a head piece wherein the lattice mast boom includes a first region and a second region which is longitudinally aligned with the first region, in the first region the lattice mast boom includes two longitudinally extending substantially parallel first strands of interconnected first lattice pieces each said first strands having a proximal end and an opposite distal end, wherein said two first strands are each releasably connected with the pivot piece via a lower cross-beam at their respective proximal ends, and in the second region the lattice mast boom only consists of a longitudinally extending second strand of interconnected second lattice pieces, said second strand having a proximal end and an opposite distal end, said second strand being releasably connected at the distal end to a head piece and at the proximal end to the first strands of lattice pieces via an upper cross-beam at the distal end of the first lattice pieces, wherein said upper cross-beam includes a distal end connected to the second strand and a proximal end connected to the first strands which is wider in a direction perpendicular to the luffing plane than the distal end of the upper cross beam and extends across substantially an entire cross section of both of said first strands, wherein the two substantially parallel first strands each include a middle axis, and the respective middle axes of the two substantially parallel first strands are equidistant from a middle axis of the second strand.

2. The lattice mast crane according to claim 1, wherein the first lattice pieces have a smaller cross-sectional area than the second lattice pieces and for transport can advantageously be pushed into the second lattice pieces.

3. The lattice mast crane according to claim 1, wherein the distance between the middle axes of the two substantially parallel first strands is at least as large as the width of the second strand.

4. The lattice mast crane according to claim 1, wherein the first strands are arranged symmetrically with respect to a middle axis of the second strand.

5. The lattice mast crane according to claim 1, wherein the first lattice pieces each have a rectangular cross-section with a longer and a shorter side and the shorter side is arranged in a plane perpendicular to the luffing plane and the second lattice pieces have a rectangular cross-section with a longer and a shorter side and the longer side is arranged in a plane perpendicular to the luffing plane.

6. The lattice mast crane according to claim 5, wherein the first lattice pieces have a smaller cross-sectional area than the second lattice pieces and for transport can advantageously be pushed into the second lattice pieces.

7. The lattice mast crane according to claim 1, in which only one hoisting cable and/or one hoisting winch is used for lifting a load.

8. The lattice mast crane according to claim 1, with at least one intermediate cross-beam for connecting the at least two first strands within the first region.

9. The lattice mast crane of claim 1 wherein the first lattice pieces are identically constructed in terms of geometry.

10. The lattice mast crane of claim 1 wherein the second lattice pieces are identically constructed in terms of geometry.

11. The lattice mast crane of claim 1 wherein the lattice mast boom is constructed substantially symmetrically with respect to a luffing plane extending through a middle axis of the lattice mast boom.

12. The lattice mast crane of claim 1 wherein each of the first and second lattice pieces comprises four longitudinal struts which in their respective terminal regions are connected via cross struts, and wherein bracing elements are connected to provide a construction of force triangles.

13. The lattice mast crane of claim 1 wherein the first lattice pieces each have a rectangular cross section with a longer side and a shorter side wherein the longer side of the first lattice pieces is arranged in a plane parallel to the luffing plane, and the second lattice pieces each have a rectangular cross section with a longer side and a shorter side, and the shorter side of the second lattice pieces are arranged in a plane parallel to the luffing plane.

14. The lattice mast crane of claim 13 wherein the first lattice pieces have a cross section less than that of the second lattice pieces wherein the second lattice pieces have an interior longitudinal space, said first lattice pieces being configured and dimensioned adapted for being slidable positioned within the interior space of the second lattice pieces.

15. The lattice mast crane of claim 1 wherein the lower cross-beam and the upper cross-beam each comprise two first connecting regions, each of said two first connecting regions having four connecting points for respective connection to one of the two first strands, and a second connecting region having four connecting points.

16. The lattice mast crane of claim 15 wherein the second connecting region of the lower cross-beam is adapted to connect to the pivot piece, and the second connecting region of the upper cross-beam is adapted to connect to the second strand.

17. The lattice mast crane of claim 16 wherein the lower cross-beam and the upper cross-beam each comprise at least two force triangles lying in a common plane, each force triangle being defined by struts connecting two of the connecting points of the first or second connecting regions with a corresponding connecting point of the third connecting region, wherein the common plane of the two force triangles is perpendicular to the luffing plane.

18. A method for modifying a lattice mast crane comprising:

a) providing a lattice mast crane with a lattice mast boom to be luffed up in a vertical luffing plane, which comprises a pivot piece, a plurality of lattice pieces releasably connectable with each other, and a head piece wherein the lattice mast boom includes a first region and a second region which is longitudinally aligned with the first region, in the first region the lattice mast boom includes two longitudinally extending substantially parallel first strands of interconnected first lattice pieces each said first strands having a proximal end and an opposite distal end, wherein said two first strands are each releasably connected with the pivot piece via a lower cross-beam at their respective proximal ends, and in the second region the lattice mast boom only consists of a longitudinally extending second strand of interconnected second lattice pieces, said second strand having a proximal end and an opposite distal end, said second strand being releasably connected at the distal end to a head piece and at the proximal end to the first strands of lattice pieces via an upper cross-beam at the distal end of the first lattice pieces, wherein said upper cross-beam includes a distal end connected to the second strand and a proximal end connected to the first strands which is wider in a direction perpendicular to the luffing plane than the distal end of the upper cross beam and extends across substantially an entire cross section of both of said first strands, wherein the two substantially parallel first strands each include a middle axis, and the respective middle axes of the two substantially parallel first strands are equidistant from a middle axis of the second strand; and, b) disconnecting the two first strands and the second strand from the upper cross-beam and the lower cross-beam; and c) inserting the two first strands into the second strand.

* * * * *